United States Patent [19]

Ward

[11] 4,125,971

[45] Nov. 21, 1978

[54] VENT AND BAFFLE

[75] Inventor: Bruce K. Ward, St. Louis Park, Minn.

[73] Assignee: Diversified Insulation, Inc., Hamel, Minn.

[21] Appl. No.: 834,322

[22] Filed: Sep. 19, 1977

[51] Int. Cl.[2] ..... E04B 7/02

[52] U.S. Cl. ..... 52/92; 52/95; 52/199

[58] Field of Search ..... 52/92, 95, 199, 303; 98/37, DIG. 6

[56] References Cited

U.S. PATENT DOCUMENTS

| | | | |
|---|---|---|---|
| 3,160,987 | 12/1964 | Pinkley | 52/95 |
| 3,683,785 | 8/1972 | Grange | 52/95 X |
| 3,863,553 | 2/1975 | Koontz | 52/95 X |
| 3,972,164 | 8/1976 | Grange | 52/95 |
| 4,069,628 | 1/1978 | Kreimer | 52/94 |

*Primary Examiner*—Ernest R. Purser
*Assistant Examiner*—Carl D. Friedman
*Attorney, Agent, or Firm*—Dorsey, Windhorst, Hannaford, Whitney & Halladay

[57] ABSTRACT

A vent and baffle used to provide an air passage between the soffit and the attic of a house to insure the flow of air through the attic. The vent is an elongated arcuate member having outwardly directed flanges adapted to be secured to the roof boards of a structure with suitable fasteners. The baffle is a block having a semi-circular recess to accommodate and support the one end of the vent against the end of the roof boards. The baffle is located in a tight fit or wedged relationship with the roof boards and top plate of the structure to block the passage between the attic and the soffit and insulate the area above the top plate of the side wall of the structure. The vent and baffle are made from a foamed plastic having flame resistant additives.

27 Claims, 8 Drawing Figures

VENT AND BAFFLE

BACKGROUND OF THE INVENTION

Vent structures are used to provide air passages between the soffit and the attic of a structure to insure the flow of air through the attic to remove hot air and moisture from the attic. When the air passages and soffit of a structure, such as a home, are blocked with insulation or air flow impeding material inadequate attic ventilation results. This causes condensation of moisture in the attic, which accumulates in the attic insulation material. This reduces the insulating effectiveness of the insulating material and may cause damage to the interior of the structure. Inadequate insulation in the attic also results in heat loss in the winter and cool air losses in the summer.

The increased cost of fuel has caused an increased use of insulation materials in the attics of structures. Fiber and foam plastic insulation materials are blown into the crawl or attic space below the roof and between the ceiling joists. Matt-type insulation material is also used. Poor air circulation can result when the spaces between the roof joists and the top wall plate are closed, as these spaces provide the air passages between the soffit and attic.

SUMMARY OF THE INVENTION

The invention is directed to a vent useable with a baffle to provide an air passage between the soffit and the attic of a structure, to prevent insulating material from accumulating and blocking the soffit area, and insulate the space above the top wall plate. The vent is a generally elongated member having an arcuate cross section and laterally and outwardly directed side flanges. The flanges are adapted to be located in surface engagement with the roof boards of a structure and are adapted to receive fasteners, such as staples, nails, and the like for attaching the vent to the roof boards. The baffle is a block configuration having a generally U-shaped top recess to accomodate the lower end of the vent. The baffle has a bottom surface and side surfaces and is of a size to wedge fit between a roof rafter and an adjacent ceiling joist, the top wall plate and roof boards of a structure. The baffle blocks or closes the passage between the attic and the soffit, and thereby prevents the movement of insulating material from the attic into the soffit. The baffle has an enlarged center portion having opposite sides which can be conveniently gripped by an installer to facilitate the placement of the baffle between a roof rafter and an adjacent ceiling joist above the top plate of the side wall. The vent and baffle are preferably made of a foam plastic, as polystyrene, polyurethane, and the like.

The vent and baffle is an effective conserver of heat energy. The vent adds to the insulation adjacent the wall plate and above the ceiling. The baffle in conjunction with the vent prevents the blow back of insulation due to high winds blowing air through the soffit vents. The baffle is used adjacent the outside edge of the top wall plate resulting in greater insulation efficiency above the wall plate. The air passage through the vent allows air to flow to the attic so that condensation moisture is not collected by the insulation in the attic. The result is that the insulation does not get wet and does not compact. The flow of air through the attic reduces summer heat and, therefore, reduces air conditioning costs. The vent and baffle can be installed with minimum time and labor and is made of low-cost high-temperature insulating materials. These and other advantages of the vent and baffle structure are embodied in the following detailed embodiment of the vent and baffle structure. It is intended that modifications and changes in the size and shapes of the structures can be made by those skilled in the art without departing from the invention.

IN THE DRAWINGS

DESCRIPTION OF PREFERRED EMBODIMENT

Figure 1:
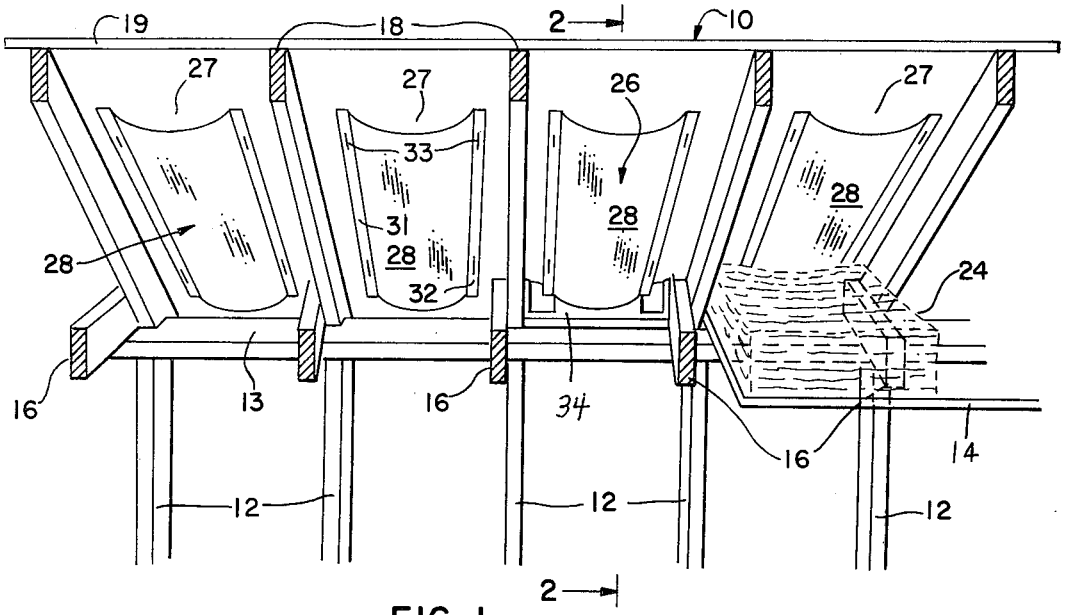
FIG. 1 is a vertical sectional view of a structure equipped with the vent and baffle of the invention.
Figure 2:
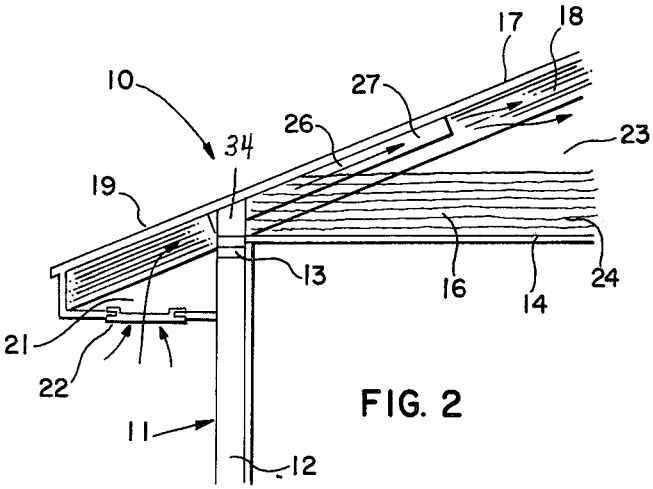
FIG. 2 is a sectional view taken along the line 2—2 of FIG. 1.

Referring to FIGS. 1 and 2, there is shown part of the structure, as a house or shelter, having an upright side wall. The side wall contains a plurality of upright wall studs 12 supporting a top plate 13. The top plate supports a ceiling 14. A plurality of laterally spaced horizontal joists 16 rest on top of plate 13 and form the supports for the ceiling. The wall studs 12 and ceiling 14 are covered with a roof 17. The roof 17 has upwardly extended rafters 18 carrying a roof cover 19, as boards, panels, or plywood sheets. The suitable protective structure, such as shingles, tiles, and the like are supported on the roof boards 19. Roof 17 has an outwardly directed overhang defining a soffit area 21. A plurality of vents 22 insures a flow of outside air into the soffit 21. It is desirable that the air flow through the soffit area and the attic to reduce the moisture and temperature of air in the attic.

Insulation material 24 is located in the attic to minimize the flow of heat through the ceiling. The insulation can be a matte material, fibrous material, vermiculite, foamed plastic materials, and the like.

The vent and baffle of the invention indicated generally at 26 located between adjacent roof rafters 18 provides an air passage 27 insures leading from soffit 21 to the attic 23 insures air passage 27 continuous flow of air from soffit 21 through attic 23.

Figure 3:
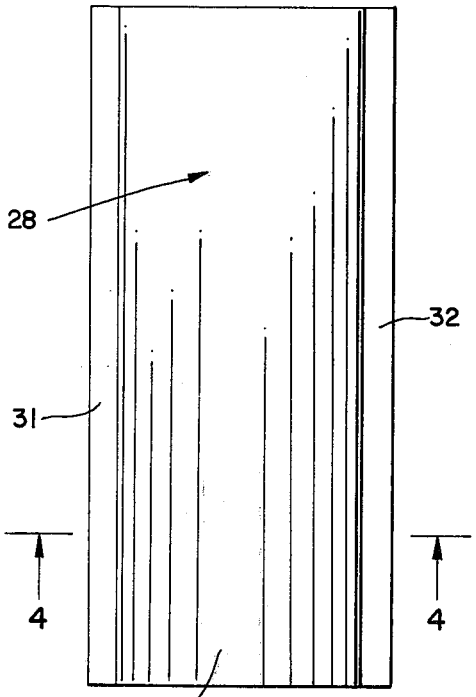
FIG. 3 is a top plan view of the vent.
Figure 4:
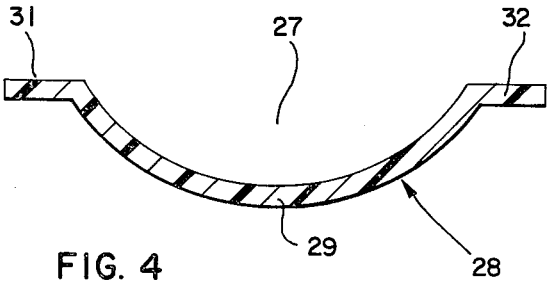
FIG. 4 is an enlarged sectional view taken along the line 4—4 of FIG. 3.

Referring to FIGS. 3, and 4, the vent indicated generally at 28 has an elongated body 29 having a longitudinal recess or groove forming the passage 27. The body 29 has a uniform arcuate cross section whereby the passage has an uniform size throughout the length of the body. A first outwardly directed flat flange 31 is integral with one side edge of body 29. A similar flat outwardly directed flange 32 is integral with the opposite side edge of body 29.

Vent 28 is made of structural material, as wood, sheet metal, cardboard, sheet plastic and foamed plastic. In one form, vent 28 is a one piece foam plastic, as polystrene with a flame resistant material. Suitable flame resistant materials, as trisphosphate, hexabromocyclododecone, and the like can be added to the polystyrene foam. Vent 28 can be made from polyurethane or polyolefin foam having flame resistant additives or coatings. Examples of suitable materials are disclosed in U.S. Pat. Nos. 3,108,016 and 3,663,463.

The vent has a length of 90cm and width of 30cm. The flanges have a width of 3cm and extend the full length of the body 29. The passage has a maximum depth of 8cm. The body and flanges have a thickness of about 1 to 1.5cm. Other sizes can be used to form vent 28.

As shown in FIG. 1, flanges 31 and 32 are positioned in flat surface engagement with the inside surface of the roof boards 19 between adjacent roof rafters 18. Fasteners 33, as staples, nails, and the like cooperate with the flanges 31 and 32 to secure the vent 28 to the roof boards. Vent 28 is positioned adjacent top plate 13 and functions as a barrier to prevent the insulation 24 from blocking the air passage 27 from the soffit 21 to attic 23.

Figure 8:
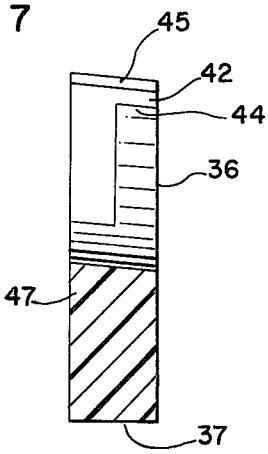
FIG. 8 is a sectional view taken along the line 8—8 of FIG. 5.

Referring to FIGS. 5 – 8, the baffle indicated generally at 34 has a solid upright back 36. The back 36 is integral with the bottom or base 37 having a flat lower surface adapted to be located in firm surface engagement with the top plate 13 between adjacent roof rafters 18. The opposite sides 38 and 39 of the back 36 extend in an upward direction and have flat outside surfaces so that they can be located in surface engagement with portions of the adjacent roof rafters. The top of body 36 has an arcuate recess 41 and outwardly directed side pockets 42 and 43. Recess 41 and side pockets 42 and 43 have substantially the same curvature and shape as the body 29 and flanges 31 and 32 of vent 28. The lower end of vent 28 fits into recess 41 with the flanges 31 and 32 located in the pockets 42 and 43. As shown in FIG. 8, the top portion 44 of wall 36 and recess surface 44 is inclined outwardly so that it holds flange 31 of the vent in firm engagement with roof boards 19. The top portion of body 36 adjacent pocket 43 has a similar inclination.

The opposite outer sections of body 36 have inclined top surfaces 45 and 46 adapted to fit into tight engagement with the roof boards 19. As shown in FIG. 8, surface 45 is inclined outwardly to accommodate the inclination or slope of roof boards 19. The top surfaces 45 and 46 engage the roof boards, while the bottom surface 37 is in firm and tight engagement with the top of plate 13 whereby baffle 34 is located in a tight friction fit relationship in the space between top plate 13 and roof boards 19.

Figure 6:
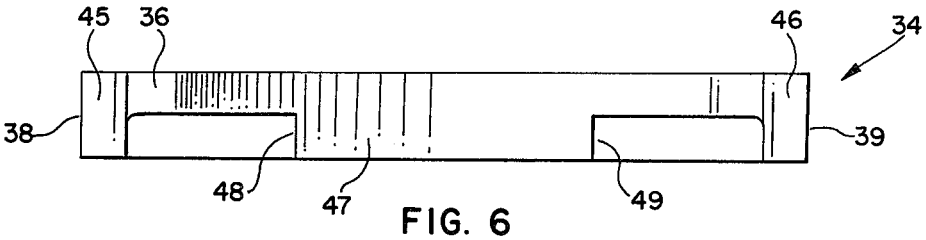
FIG. 6 is a top plan view of FIG. 5.
Figure 5:
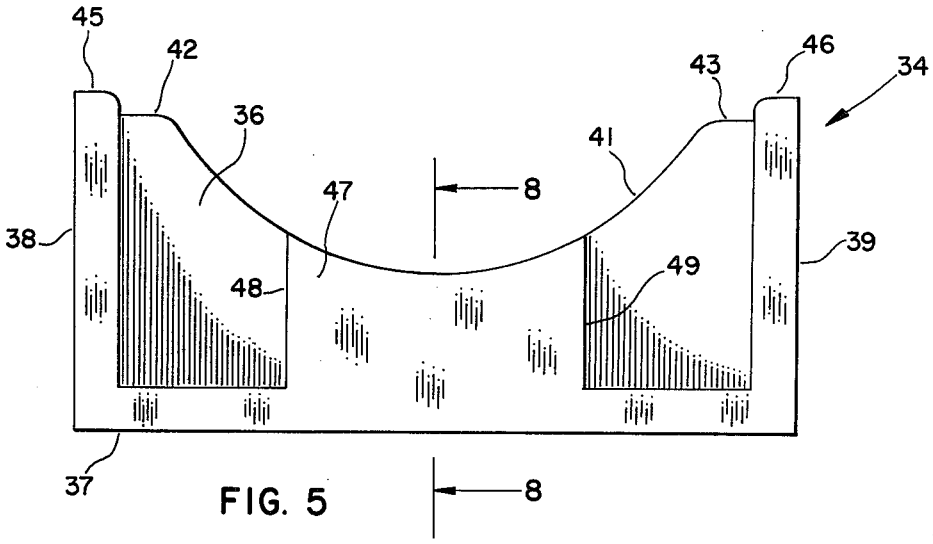
FIG. 5 is a front elevational view of the inside of the baffle.
Figure 7:
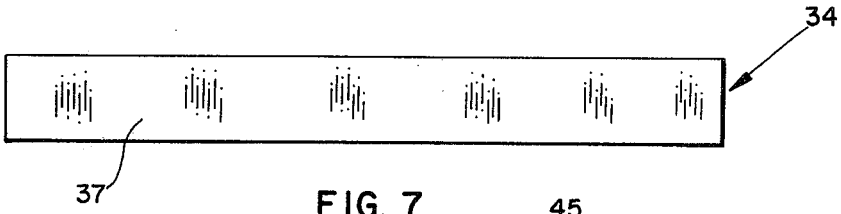
FIG. 7 is a bottom plan view of FIG. 5.

As shown in FIGS. 5, 6 and 8, the center of the back 36 has a central web 47. Web 47 has opposite upright side surfaces 48 and 49. The web 47 is an enlarged central portion of the back 46 which increases the strength of the back 36 and provides a means for gripping the baffle 34 so that it can be readily replaced above the top plate.

In one form, baffle 34 is a one piece foam plastic, as polystrene with suitable flame retardants. The baffle has a width of 34cm, a height of 15cm, and a thickness of 4cm. Other sizes and dimensions can be used to form the baffle.

In use, the vent and baffle, as shown in FIG. 1, is located between adjacent roof rafters 18 to provide an air passage 27 between soffit area 21 and attic space 23. Vent 28 is located adjacent the roof boards 19. Flanges 31 and 32 rest on the inside surface of the roof boards 19 and can be attached thereto with fasteners 33. The lower end of vent 28 is located adjacent the top plate 13. In some installations, vent 26 can extend down into soffit area 21. Baffle 34 cradles around the lower end of vent 28 to block the passage between the soffit and the attic, except for vent passage 27. Baffle 34 also functions as a barrier to prevent the movement of the insulation 24 from the attic into soffit 21. The lower flat side 37 of the baffle bears against the top of top plate 13. The top inclined surfaces 45 and 46 of the baffle are in firm engagement with the inside of the roof cover 19 whereby the baffle 34 is wedged between top plate 13 and roof boards 19. The sides 38 and 39 are in firm engagement with the facing sides of a roof rafter 18 and ceiling joist 16. The web 47 is used by the installer to position the baffle 34 in the space above top plate 13. The side surfaces 48 and 49 provide convenient means for the thumb and fingers of the installer to manipulate and force the baffle 34 into its proper position.

FIG. 1 also shows the vent 28 being used between adjacent roof rafters 18 without the baffle. A plurality of fasteners 33, as staples, nails and the like extend through the flanges 31 and 32 to attach the vent 28 to the roof boards. The vent provides the air passage 27 from adjacent the soffit area to the attic.

The vent 28 and baffle 34 are constructed of foam material, as expanded polystyrene, having flame-retardant' characteristics. Other types of foamed plastic matericals can be used for the vent and baffle. Also, the vent and baffle can be made of structural materials, such as wood, sheet metal, cardboard, masonite, hardboard, and like materials.

While there has been shown and described an embodiment of the vent and baffle, it is understood that changes in the cross sectional shapes of the vent and baffle can be made by those skilled in the art without departing from the invention. The invention is defined in the following claims.

The embodiments of the invention in which an exclusive property or privilege is claimed are defined as follows:

1. A vent for use with a baffle for providing an air passage between the soffit and attic of a structure having a top wall plate, roof rafters, ceiling joists, and a roof cover secured to the roof rafters forming an opening between the soffit and attic, said baffle having a top arcuate recess and top side pockets comprising:

an elongated arcuate shaped body having a longitudinal groove and opposite longitudinal side edges, and outwardly directed side flanges secured to the side edges of the body, said side flanges extended along the side edges of the body, said body having an arcuate cross sectional shape, a portion of said body adapted to fit into the arcuate recess of the baffle and said side flanges adapted to fit into the side pockets whereby when the baffle is located on the top wall plate the baffle holds the side flanges in engagement with the roof cover so that the groove of the body forms with the roof cover an air passage between the soffit and attic.

2. The vent of claim 1 wherein: the vent is made of foamed plastic.

3. The vent of claim 1 wherein: the vent is made of sheet metal.

4. The vent of claim 1 wherein: the vent is made of cardboard.

5. The vent of claim 1 wherein:

the vent is made of plastic material.

6. The vent of claim 1 wherein: the vent has a length of about three times its width.

7. The vent of claim 1 wherein: the side flanges extend the full length of the body.

8. The vent claim 7 wherein: each side flange has a flat surface adapted to engage the roof cover.

9. The vent of claim 1 wherein: said vent is a one-piece foam plastic member, said side flanges being integral with the side edges of the body and extended the full length of the body.

10. A vent for providing an air passage between the soffit and attic of a structure having roof rafters, and a roof cover secured to the roof rafters comprising:

an elongated body having a longitudinal groove along the entire length of the body forming an air passage, said body having a non-linear cross section forming said longitudinal groove and longitudinal side edges on opposite sides of the groove, and a flange secured to one side edge, said flange having a generally flat side surface engageable in surface engagement with the roof cover, said flange having a width adapted to accommodate fastening means to attach the flange to the roof cover, a second flange secured to the other side edge of the body, said second flange having a generally flat side surface engageable in surface engagement with the roof cover, said seconf flange having a width adapted to accommodate fastening means to attach second flange to the roof cover to hold the vent in engagement with the roof cover so that the groove in the body of the vent forms with the roof cover an air passage between the soffit and the attic.

11. The vent of claim 10 wherein: both flanges extend the full length of the body.

12. The vent of claim 11 wherein: the vent is a one-piece foamed plastic member.

13. The vent of claim 10 wherein: the vent has a length of about three times its width.

14. The vent of claim 10 wherein: the vent is a one-piece foamed plastic member.

15. The vent of claim 10 wherein: the vent is a sheet metal member.

16. A vent for providing an air passage between the soffit and attic of a structure having a top wall plate, roof rafters, and a roof cover attached to the roof rafters forming an opening between the soffit and attic comprising: a one-piece rigid member including an elongated body having a longitudinal groove along the entire length of the body forming an air passage, said body having an arcuate cross section and longitudinal side edges on opposite sides of the groove, a first flange integral with one side edge and extended outwardly therefrom, a second flange integral with the other side edge and extended outwardly therefrom, said first and second flanges extending the full length of the body, each flange having a generally flat side surface, said first and second flanges adapted to engage the roof cover to accommodate fastening means to attach the flanges to the roof cover thereby holding the vent in engagement with the roof cover so that the groove in the body of the vent forms with the roof cover an air passage between the soffit and the attic.

17. The vent of claim 16 wherein: the body has an arcuate cross sectional shape and a generally uniform thickness.

18. The vent of claim 16 wherein: the body has an arcuate cross sectional shape, and said body and first and second flanges have generally the same thickness.

19. The vent of claim 16 wherein: the vent has a length about three times its width.

20. The vent of claim 16 wherein: the one-piece member is a one-piece foamed plastic member.

21. A vent for use with a baffle for providing an air passage between the soffit and attic of a structure having a top wall plate, a roof cover, and openings between the roof cover and wall plate connecting the soffit with the attic, said baffle having a top recess for accommodating a part of the vent comprising: an elongated body having a longitudinal groove and opposite longitudinal side edges, a portion of said body adapted to fit into the top recess of the baffle whereby when the baffle is located on the top wall plate the baffle holds the side edges of the body in engagement with the roof cover so that the groove in the body forms with the roof cover an air passage between the soffit and attic.

22. The vent of claim 20 including: a side flange secured to one side edge of the body, said flange extended outwardly in a lateral direction from the body, said baffle having a top side pocket for accommodating the side flange.

23. The vent of claim 21 wherein: the side flange extends the full length of the body.

24. The vent of claim 20 including: a side flange secured to each side edge of the body, each side flange extended outwardly in a lateral direction from the sides of the body, said baffle having side pockets on opposite sides of the groove for accommodating the side flanges.

25. The vent of claim 24 wherein: each side flange extends the full length of the body.

26. The vent of claim 21 wherein: the vent is a one-piece foamed plastic member.

27. The vent of claim 21 wherein: the vent is sheet metal member.

* * * * *